US009787017B1

(12) United States Patent
Lane et al.

(10) Patent No.: US 9,787,017 B1
(45) Date of Patent: Oct. 10, 2017

(54) ELECTRICAL CONNECTOR WITH TWO-PIECE CAVITY INSERT

(71) Applicant: TYCO ELECTRONICS CORPORATION, Berwyn, PA (US)

(72) Inventors: David James Lane, Hummelstown, PA (US); Douglas John Hardy, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/073,060

(22) Filed: Mar. 17, 2016

(51) Int. Cl.
*H01R 13/506* (2006.01)
*H01R 24/40* (2011.01)
*H01R 9/05* (2006.01)
*H01R 103/00* (2006.01)

(52) U.S. Cl.
CPC ..... *H01R 13/506* (2013.01); *H01R 9/05* (2013.01); *H01R 24/40* (2013.01); *H01R 2103/00* (2013.01)

(58) Field of Classification Search
CPC ..... H01R 13/516; H01R 13/502; H01R 9/05; H01R 9/0518; H01R 13/506; H01R 24/40; H01R 2103/00
USPC ..... 439/578, 585, 465, 731
See application file for complete search history.

(56) References Cited

U.S. PATENT DOCUMENTS 4,593,964 A * 6/1986 Forney, Jr. ..... H01R 24/562 439/580
5,695,357 A * 12/1997 Wright ..... H01R 4/50 29/877
6,450,829 B1 * 9/2002 Weisz-Margulescu ..... H01R 13/424 439/263
6,609,931 B2 * 8/2003 Parrish ..... H01R 13/17 439/108
8,366,483 B2 * 2/2013 Hardy ..... H01R 9/0518 439/578
9,142,895 B2 * 9/2015 Hardy ..... H01R 9/0518
2007/0093120 A1 4/2007 Hardy et al.

FOREIGN PATENT DOCUMENTS

WO 2012163777 A1 12/2012

OTHER PUBLICATIONS

International Search Report, International Application No. PCT/B2017/051494, International Filing Date Mar. 15, 2017.

* cited by examiner

*Primary Examiner* — Tulsidas C Patel
*Assistant Examiner* — Travis Chambers

(57) ABSTRACT

An electrical connector includes an outer contact and a cavity insert. The outer contact has a mating segment, a terminating segment, and a middle segment therebetween. The cavity insert surrounds the middle segment of the outer contact. The cavity insert is defined by an upper shell and a lower shell that couple together at an interface. The upper shell extends along a portion of a perimeter of the outer contact, and the lower shell extends along a remaining portion of the perimeter of the outer contact. The upper shell includes a first strap that extends across the interface. The first strap includes a latching surface that engages a corresponding first catch of the lower shell to couple the upper shell to the lower shell.

19 Claims, 5 Drawing Sheets

ELECTRICAL CONNECTOR WITH TWO-PIECE CAVITY INSERT

BACKGROUND OF THE INVENTION

The subject matter herein relates generally to connector assemblies.

Radio frequency (RF) connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

In order to standardize various types of connector assemblies, particularly the interfaces for such connector assemblies, certain industry standards have been established. One of these standards is referred to as FAKRA, which is an abbreviation for the German term Fachnormenausschuss Kraftfahrzeugindustrie. FAKRA is the Automotive Standards Committee in the German Institute for Standardization, representing international standardization interests in the automotive field. The FAKRA standard provides a system, based on keying and color coding, for proper connector attachment. Specific jack keys can only be connected to like plug keyways in FAKRA connectors. Secure positioning and locking of connector housings is facilitated by way of a FAKRA-defined catch on the housing of a jack or first assembly and a cooperating latch on the housing of a plug or second assembly.

The connector assemblies typically include a housing with a mating interface for coupling to a mating connector. The housing holds a contact assembly that electrically connects to corresponding mating contacts of the mating connector. A cavity insert of the contact assembly is typically used to secure the contact assembly within the housing so the contact assembly does not become dislodged as the mating connector is mated or unmated from the housing. The cavity insert is an adapter that engages both an outer contact of the contact assembly and an interior portion of the housing. The cavity insert may allow the contact assembly to be compatible with various different housings.

Typically, the cavity insert is cylindrical and is loaded over the outer contact by sliding the cavity insert over an end of the outer contact. For example, the cavity insert may be loaded over a rear end of the outer contact which has a smaller diameter than a front end of the outer contact. However, sliding the cavity insert over an end of the outer contact may not be feasible or at least desirable in some connectors. For example, some known outer contacts are configured to electrically connect to relatively large cables at the rear end of the outer contact, so the rear end of the outer contact may be too large to be received within the cavity insert. Due to spacing restrictions within the housing, it may not be possible to enlarge the cavity insert in order to accommodate the large rear end of the outer contact. Furthermore, some known outer contacts are formed on carrier strips, and the contact assembly may be assembled while the outer contact remains on the carrier strip. Even if the rear end of the outer contact is small enough to be received within the cavity insert, the rear end may be secured to the carrier strip which blocks the ability of the cavity insert to be loaded over the rear end. A need remains for an electrical connector that is able to accommodate various outer contacts therein while adhering to the space restrictions within the housing and any applicable industry standard specifications.

BRIEF DESCRIPTION OF THE INVENTION

In one embodiment, an electrical connector is provided that includes an outer contact and a cavity insert. The outer contact has a mating segment, a terminating segment, and a middle segment therebetween. The mating segment is configured to engage a mating contact of a mating connector. The terminating segment is configured to be electrically connected to a cable. The cavity insert defines a channel that receives the outer contact therein. The cavity insert surrounds the middle segment of the outer contact. The cavity insert is defined by an upper shell and a lower shell that couple together at an interface. The upper shell extends along a portion of a perimeter of the outer contact, and the lower shell extends along a remaining portion of the perimeter of the outer contact. The upper shell includes a first strap that extends across the interface. The first strap includes a latching surface that engages a corresponding first catch of the lower shell to couple the upper shell to the lower shell.

In another embodiment, an electrical connector is provided that includes an outer contact and a cavity insert. The outer contact has a mating segment, a terminating segment, and a middle segment therebetween. The mating segment is configured to engage a mating contact of a mating connector. The terminating segment is configured to be electrically connected to a cable. The cavity insert defines a channel that receives the outer contact therein. The cavity insert surrounds the middle segment of the outer contact. The cavity insert is defined by an upper shell and a lower shell that couple together at an interface. The upper shell extends along a portion of a perimeter of the outer contact, and the lower shell extends along a remaining portion of the perimeter of the outer contact. The upper shell has a curved body extending between a first edge and a second edge. The upper shell includes a first strap extending from the first edge towards the lower shell. The first strap includes a latching surface. The upper shell further includes a first catch extending from an outer surface of the upper shell proximate to the second edge. The lower shell has an identical shape as the upper shell and is oriented 180 degrees relative to the upper shell about a mating axis that is parallel to the channel. The first edge of the upper shell aligns with a second edge of the lower shell such that the latching surface of the first strap of the upper shell engages a first catch of the lower shell. The second edge of the upper shell aligns with a first edge of the lower shell such that the first catch of the upper shell engages a latching surface of a first strap of the lower shell.

In another embodiment, an electrical connector is provided that includes an outer housing and a contact assembly. The outer housing has a front end and defines a cavity that extends into the outer housing from the front end. The cavity is configured to receive a mating connector therein along a mating axis. The contact assembly is disposed within the cavity of the outer housing. The contact assembly includes a center contact, a dielectric body, an outer contact, and a cavity insert. The center contact is configured to engage a first mating contact of the mating connector. The dielectric body surrounds the center contact. The outer contact surrounds the dielectric body. The outer contact extends between a mating segment and a terminating segment. The mating segment is configured to engage a second mating contact of the mating connector. The terminating segment is configured to be electrically connected to a cable. The cavity insert surrounds the outer contact. The cavity insert is defined by an upper shell and a lower shell that couple together at an interface. The upper shell extends along a portion of a perimeter of the outer contact, and the lower shell extends along a remaining portion of the perimeter of the outer contact. The upper shell includes a first strap that extends across the interface. The first strap includes a latching surface that engages a corresponding first catch of the lower shell to couple the upper shell to the lower shell.

DETAILED DESCRIPTION OF THE INVENTION

One or more embodiments described herein disclose a connector system that includes a first connector and a second connector. At least one of the first connector or the second connector includes an outer contact and a cavity insert that surrounds the outer contact. The cavity insert extends between the outer contact and an outer housing of the connector to hold the outer contact (and any components within and/or coupled to the outer contact) in a secured position relative to the outer housing. The cavity insert has a two-piece construction that is formed of two shells that couple together to define the cavity insert. The two shells are moved towards each other to be coupled together with the outer contact between the two shells. Thus, the cavity insert is not loaded axially over an end of the outer contact in order to surround the outer contact.

The two shells are coupled to one another by a latching mechanism. The latching mechanism includes at least one strap that extends from one of the shells towards the other shell and a catch on the other shell that engages a latching surface on the strap. The latching mechanism may include multiple straps and corresponding catches. Optionally, each shell may be hermaphroditic, including both at least one catch and at least one latching strap. In an embodiment, the latching components (e.g., the latching straps and catches) of each shell are integrally formed on the respective shell, such as during a molding process. Furthermore, the two shells may have an identical shape as one another, such that the same mold or process may be used to make both shells that couple to form the cavity insert.

As used herein, the term "surrounding" means extending around a periphery of another object in at least one dimension, such as encircling the object along a segment of the length of the object. The term "surrounding" as used herein does not necessarily require that the surrounded object be completely enclosed or encased by the surrounding object in all dimensions.

Figure 1:
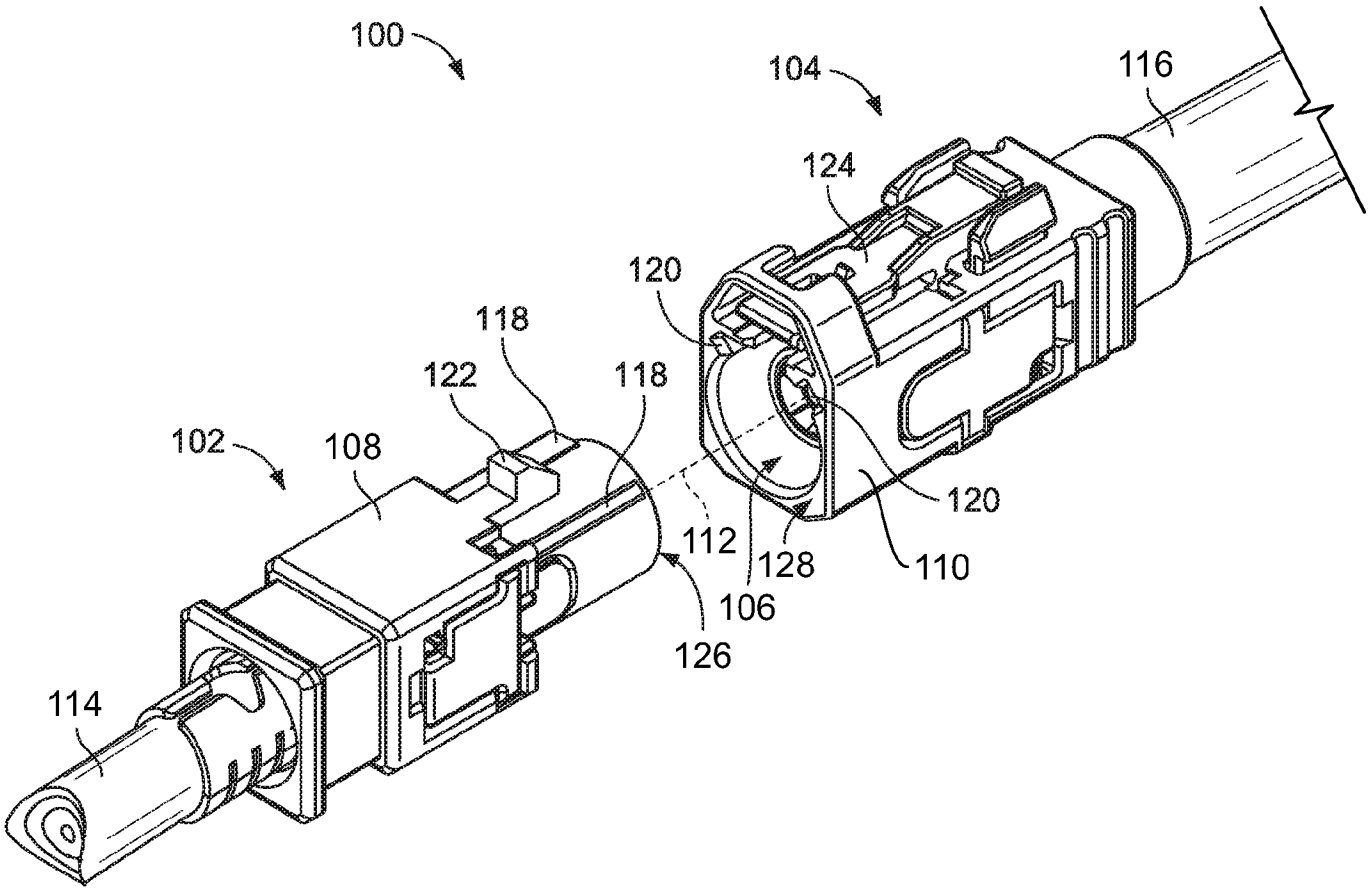
FIG. 1 illustrates a connector system formed in accordance with an exemplary embodiment.

FIG. 1 illustrates a connector system 100 formed in accordance with an exemplary embodiment. The connector system 100 includes a first electrical connector 102 and a second electrical connector 104 that are configured to be mated together to transmit electrical signals therebetween. In the illustrated embodiment, the first electrical connector 102 is a male connector, and the second electrical connector 104 is a female connector, such that a portion of the first electrical connector 102 is received within a cavity 106 of the second electrical connector 104 during a mating operation. More specifically, a male housing 108 (e.g., a nose cone) of the first connector 102 is received within the cavity 106 defined by a female housing 110 of the female connector 104. Although shown as un-mated in FIG. 1, the first and second connectors 102, 104 are poised for mating along a mating axis 112. As used herein, the first electrical connector 102 is referred to as male connector 102 or mating connector 102, and the second electrical connector 104 is referred to as female connector 104 or simply as connector 104.

The connector system 100 may be used in numerous applications across various industries, such as the automotive industry, the home appliance industry, the aviation industry, and the like, to electrically couple two or more devices and/or electrical components. For example, in the automotive industry, the electrical connectors 102, 104 may be used for radio frequency communications, such as to electrically connect an antenna to a controller and/or processing device.

The male connector 102 and the female connector 104 each electrically connect to different electrical components and provide a conductive pathway between the corresponding electrical components. In the illustrated embodiment, the male connector 102 and the female connector 104 are electrically connected to corresponding conductive cables or wires 114, 116, such as coaxial cables. In an alternative embodiment, the male connector 102 and/or the female connector 104 may be mounted (e.g., edge-mounted) to a corresponding circuit board. The cable 114 is electrically terminated (e.g., crimped, soldered, etc.) to electrical contacts of the male connector 102. The cable 116 is electrically terminated to electrical contacts of the female connector 104. The electrical contacts of the male connector 102 engage the electrical contacts of the female connector 104 when the connectors 102, 104 are mated. Various electrical signals conveying power, control messages, data, or the like, may be transmitted through the connectors 102, 104 between the cable 114 and the cable 116.

The male connector 102 and the female connector 104 both have in-line shapes in the illustrated embodiment. For example, the mating axis 112 along which the male connector 102 is loaded into the cavity 106 is generally parallel to the orientations of the cable 114 exiting the male connector 102 and the cable 116 exiting the female connector 104. In an alternative embodiment, the male connector 102 and/or the female connector 104 may have a right angle shape.

In the illustrated embodiment, the male connector 102 and the female connector 104 constitute FAKRA connectors which are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at specific impedances, such as 50, 75, 93, and/or 125 Ohms. The connector system 100 may utilize other types of connectors other than the FAKRA connectors described herein.

During mating, a front end 126 of the male connector 102 is moved along the mating axis 112 and is plugged into the cavity 106 of the female connector 104 through a front end 128 thereof. As used herein, relative or spatial terms such as "front," "rear," "top," or "bottom" are only used to distinguish the referenced elements and do not necessarily require particular positions or orientations relative to the surrounding environment of the connector system 100. The male connector 102 has one or more keying features 118, and the female connector 104 has one or more keying features 120 that complement the keying features 118 of the male connector 102. In the illustrated embodiment, the keying features 118 are ribs and the keying features 120 are channels that receive the ribs 118. Any number of keying features 118, 120 may be provided. The keying features 118, 120 may be part of the standardized design of the FAKRA connector. For example, the keying ribs 118 and the keying channels 120 may be configured to restrict the mate-ability of each of the connectors 102, 104 to one or more specific mating connectors.

The male connector 102 has a latching feature 122 that is configured to engage a complementary latching feature 124 of the female connector 104 to retain a mating connection between the two connectors 102, 104 (by restricting undesired un-mating of the connectors 102, 104). In the illustrated embodiment, the latching feature 122 is a catch, and the latching feature 124 is a deflectable latch that engages the catch 122 when the connectors 102, 104 are mated together. The latch 124 is configured to be lifted or pivoted over the catch 122 in order to disconnect the male and female connectors 102, 104.

Figure 2:
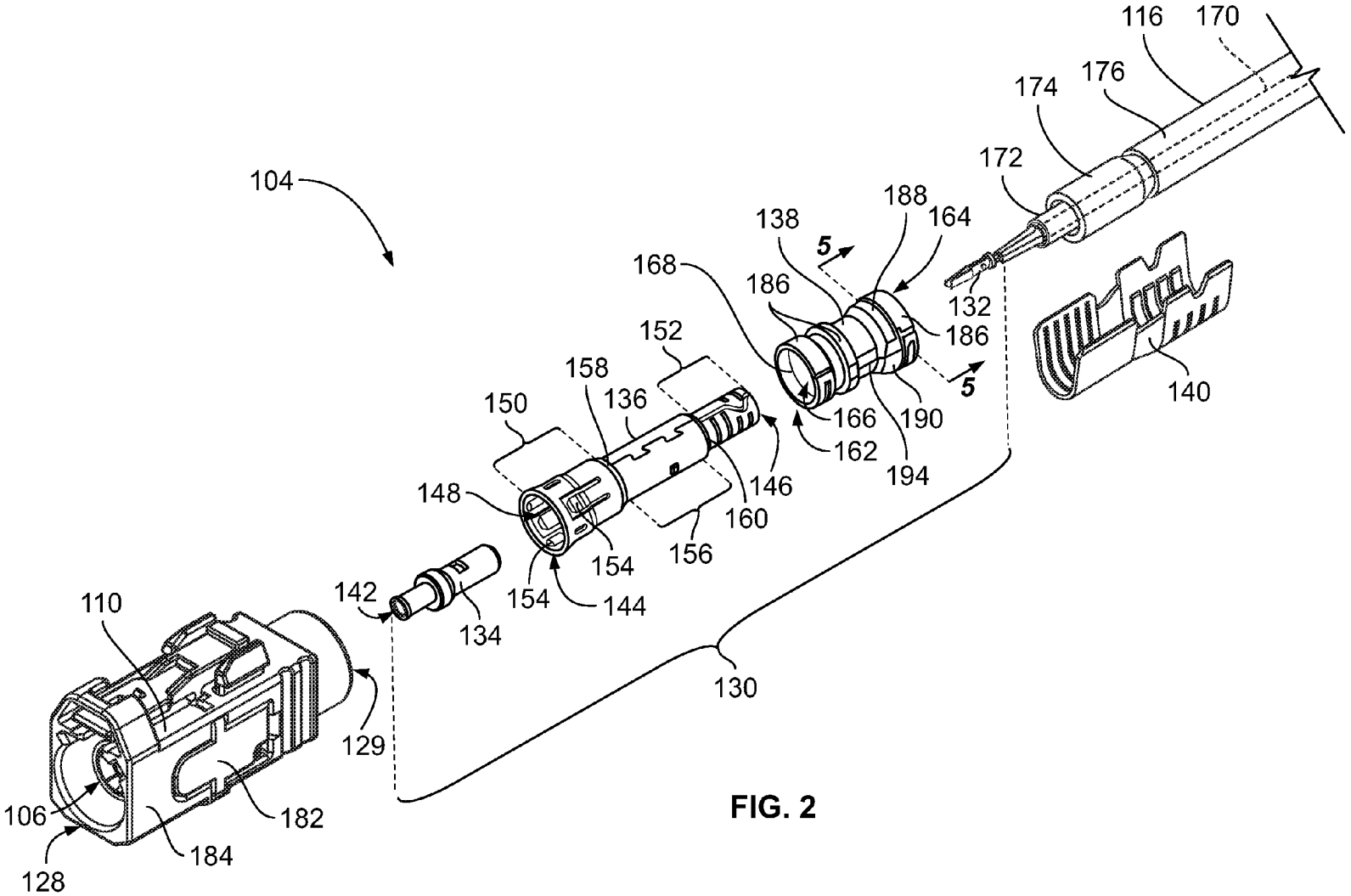
FIG. 2 is an exploded view of a female connector and a cable of the connector system according to an embodiment.

FIG. 2 is an exploded view of the female connector 104 and the cable 116 according to an embodiment. The female connector 104 includes the female housing 110 (also referred to herein as outer housing 110) and a contact assembly 130. The contact assembly 130 is held within the outer housing 110. The contact assembly 130 includes a center contact 132, a dielectric body 134, an outer contact 136, a cavity insert 138, and an optional ferrule 140. In other embodiments, the female connector 104 may include one or more additional components and/or may not include all of the listed components.

The cable 116 may be a coaxial cable that has a center conductor 170 (for example, one or more wires) surrounded by a dielectric layer 172. A cable braid 174 surrounds the dielectric layer 172. The cable braid 174 provides shielding for the center conductor 170 along the length of the cable 116. A cable jacket 176 surrounds the cable braid 174 and provides protection for the cable braid 174, the dielectric layer 172, and the center conductor 170 from external forces and contaminants. The cable 116 is configured to be electrically connected to the contact assembly 130 via crimping, soldering, or the like.

In the illustrated embodiment, the center contact 132 of the contact assembly 130 constitutes a socket contact that is configured to receive and electrically engage a pin contact of the male connector 102 (shown in FIG. 1). Alternatively, the center contact 132 may be a pin contact or another type of contact. The center contact 132 is composed of a conductive material such as one or more metals. The center contact 132 is terminated to the center conductor 170 of the cable 116, such as via crimping.

The dielectric body 134 surrounds the center contact 132. For example, the dielectric body 134 defines a passage 142 that receives the center contact 132 therein. The dielectric body 134 is composed of a dielectric material, such as one or more plastics. The dielectric body 134 is configured to extend between the center contact 132 and the outer contact 136 to electrically insulate the two contacts 132, 136 from each other.

The outer contact 136 surrounds the dielectric body 134 and the center contact 132 that is within the dielectric body 134. The outer contact 136 is composed of a conductive material such as one or more metals. The outer contact 136 provides shielding for the center contact 132, such as from electromagnetic or radio frequency interference. The outer contact 136 is configured to be electrically connected to the cable braid 174 of the cable 116.

The outer contact 136 extends between a front end 144 and a rear end 146, and defines a chamber 148 that extends through the outer contact 136 between the front and rear ends 144, 146. The dielectric body 134 is received in the chamber 148, and the cable 116 that is terminated to the center contact 132 protrudes from the rear end 146 of the outer contact 136. The outer contact 136 has a generally cylindrical or barrel shape. In an embodiment, the outer contact 136 is stamped and formed into the cylindrical shape by stamping and then rolling a panel of sheet metal.

The outer contact 136 includes a mating segment 150 that extends rearward from the front end 144 and a terminating segment 152 that extends frontward from the rear end 146. The mating segment 150 is configured to engage an outer mating contact (not shown) of a mating connector, such as the male connector 102 (shown in FIG. 1). The mating segment 150 may include one or more retention features 154, such as deflectable beams, bumps, barbs, or the like in order to maintain engagement between the mating segment 150 of the outer contact 136 and the outer mating contact. The terminating segment 152 is configured to be electrically connected to the cable braid 174 of the cable 116. For example, the cable braid 174 may surround the terminating segment 152 and may be crimped to the terminating segment 152 via the ferrule 140. Optionally, the outer contact 136 may include a middle segment 156 between the mating segment 150 and the terminating segment 152 along the length of the outer contact 136. The middle segment 156 may have a different diameter than at least one of the mating segment 150 and the terminating segment 152. For example, in the illustrated embodiment, the middle segment 156 has a smaller diameter than the mating segment 150 and a larger diameter than the terminating segment 152. The outer contact 136 is stepped along the length to define at least a first step 158 and a second step 160. The first step 158 separates the mating segment 150 from the middle segment 156. The second step 160 separates the middle segment 156 from the terminating segment 152. In an alternative embodiment, the terminating segment 152 may have a larger diameter than the middle segment 150, such as if the terminating segment 152 is configured to electrically connect to a cable that is larger than the cable 116.

The cavity insert 138 surrounds at least a portion of the outer contact 136. The cavity insert 138 extends between a front end 162 and a rear end 164 and defines a channel 166 that extends through the cavity insert 138 between the front and rear ends 162, 164. The outer contact 136 is held within the channel 166. In an embodiment, the outer contact 136 surrounds the middle segment 156 of the outer contact 136, such that an inner surface 168 of the cavity insert 138 engages the middle segment 156. The cavity insert 138 optionally may surround at least a portion of the mating segment 150 and/or the terminating segment 152. The inner surface 168 of the cavity insert 138 may engage the first step 158 and/or the second step 160. The cavity insert 138 is configured to secure the outer contact 136 axially within the channel 166, such that the outer contact 136 does not move axially relative to the cavity insert 138. Optionally, the cavity insert 138 does not allow the outer contact 136 to rotate relative to cavity insert 138. The cavity insert 138 is an adapter that is configured to engage the outer housing 110 to hold the contact assembly 130 in a fixed axial position within the cavity 106 of the housing 110. For example, the cavity insert 138 may include at least one flange 186 that extends circumferentially along a perimeter of the cavity insert 138. The flange 186 is configured to engage the outer housing 110 within the cavity 106 in order to secure the axial position of the contact assembly 130.

The ferrule 140 is configured to be crimped over the cable 116 to the terminating segment 152 of the outer contact 136. The ferrule 140 provides electrical termination of the braid 174 to the outer contact 136 and strain relief for the cable 116. In an exemplary embodiment, the ferrule 140 is configured to be crimped to both the cable braid 174 and the cable jacket 176 of the cable 116.

The female outer housing 110 extends between the front end 128 and a rear end 129. The outer housing 110 has a generally box shaped outer profile. The cavity 106 of the outer housing 110 may be a generally cylindrical bore extending through the outer housing 110. The cavity 106 may have steps, shoulders and/or channels formed therein for engaging and securing the cavity insert 138 therein.

In an embodiment, the outer housing 110 is configured to receive a retainer clip 182 that extends through an opening in a side wall 184 of the housing 110. The retainer clip 182 is configured to be loaded into the housing 110 subsequent to the contact assembly 130 in order to secure the contact assembly 130 to the housing 110. For example, the retainer clip 182 may engage one or more flanges 186 of the cavity insert 138 to secure the axial position of the contact assembly 130 within the cavity 106.

Although the female connector 104 is shown and described in FIG. 2, the male connector 102 (shown in FIG. 1) may have similar and/or identical components as the components of the female connector 104. For example, the male connector 102 may include a contact assembly that is received within the male housing 108 (shown in FIG. 1). The contact assembly of the male connector 102 may include a center contact, a dielectric body, an outer contact, and a cavity insert that are at least similar to the components of the contact assembly 130 described in FIG. 2. For example, the male connector 102 may include a cavity insert that is similar to the cavity insert 138 of the female connector 104 shown and described below.

In an embodiment, the cavity insert 138 is formed of a two-piece construction, including a first shell 188 and a second shell 190. The first and second shells 188, 190 are separate, discrete parts that couple together to define the cavity insert 138. For example, the first shell 188 extends along a portion of the perimeter of the outer contact 136, and the second shell 190 extends along a remaining portion of the perimeter of the outer contact 136. The first and second shells 188, 190 engage one another at an interface 194 to form the assembled and intact cavity insert 138 that is shown in FIG. 2.

Figure 3:
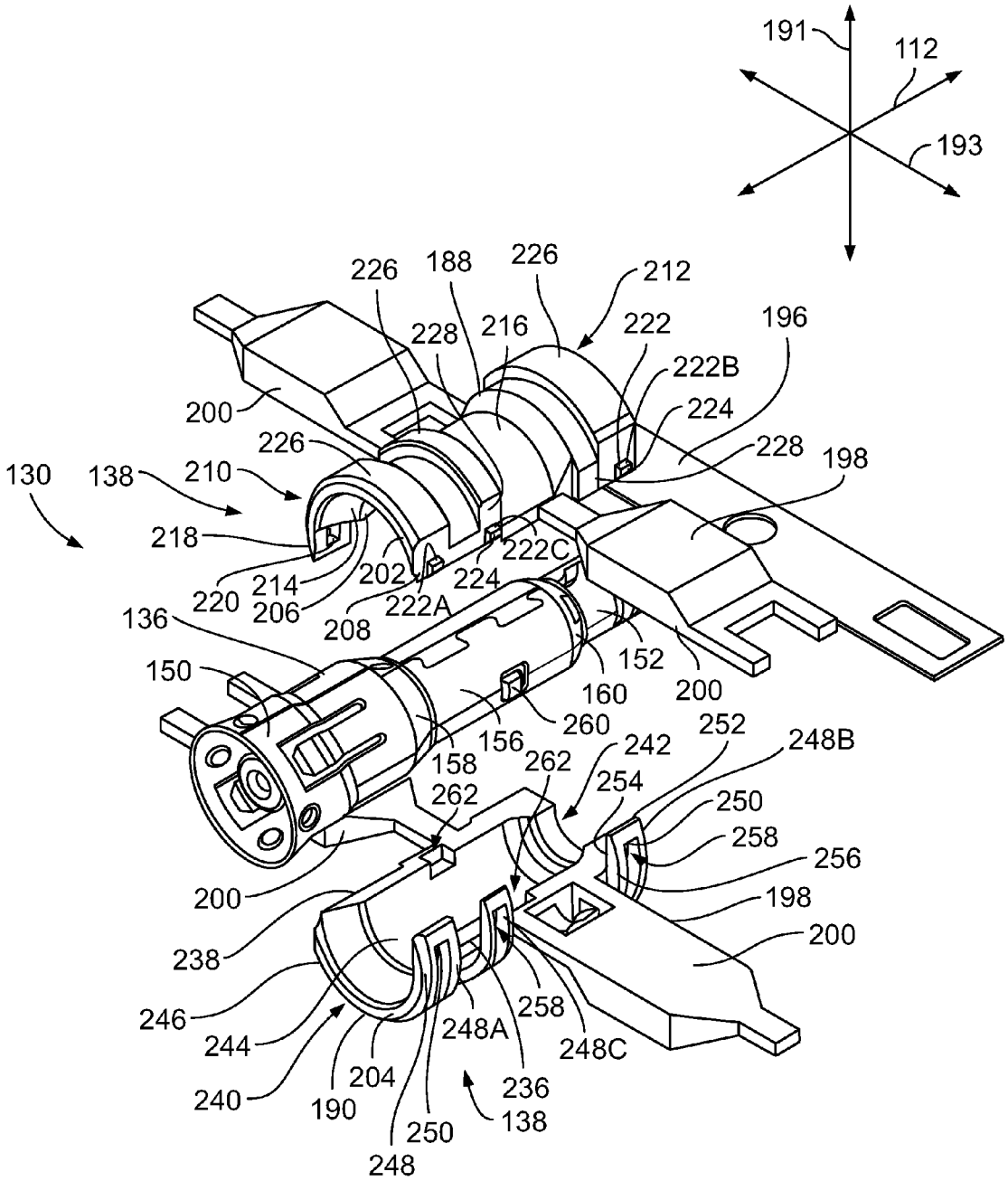
FIG. 3 is a perspective exploded view of a contact assembly of the female connector according to an embodiment.

FIG. 3 is a perspective exploded view of the contact assembly 130 of the female connector 104 according to an embodiment. The center contact 132 (shown in FIG. 2) within the dielectric body 134 is not visible in the illustrated embodiment. The contact assembly 130 is oriented with respect to a vertical or elevation axis 191, a lateral axis 193, and the mating axis 112. The axes 191, 193, 112 are mutually perpendicular. Although the elevation axis 191 appears to extend in a generally parallel to gravity, it is understood that the axes 191, 193, 112 are not required to have any particular orientation with respect to gravity. In FIG. 3, the first shell 188 extends above the outer contact 136 (along the vertical axis 191), and the second shell 190 is disposed below the outer contact 136. As used herein, the first shell 188 is referred to as an upper shell 188 and the second shell 190 is referred to as a lower shell 190. As stated above, the terms "upper" and "lower" are only used to distinguish the referenced elements and do not necessarily require particular positions or orientations relative to the surrounding environment of the female connector 104. Thus, the upper shell 188 may be below the lower shell 190 if the contact assembly 130 is rotated 180 degrees.

Optionally, the outer contact 136 is connected to a metal carrier strip 196 when the cavity insert 138 is assembled around the outer contact 136. The terminating segment 152 of the outer contact 136 is mechanically connected to the carrier strip 196. Since the carrier strip 196 is connected to the terminating segment 152, a pre-assembled cavity insert 138 is not able to be received over the terminating segment 152 to surround the outer contact 136. The channel 166 (shown in FIG. 2) of the cavity insert 138 may be smaller in diameter than the mating segment 150, such that the cavity insert 138 also cannot be loaded over the mating segment 150. Thus, a pre-assembled cavity insert 138 would not be able to surround the outer contact 136. In the illustrated embodiment, since the cavity insert 138 has a two-piece construction, the cavity insert 138 may be assembled around the outer contact 136. For example, the cavity insert 138 is assembled in-situ around the outer contact 136 such that the outer contact 136 is disposed between the two shells 188, 190 as the two shells 188, 190 are coupled together.

Optionally, the upper and lower shells 188, 190 may each be connected to respective plastic carrier strips 198. The carrier strips 198 include links 200 that extend outward from the respective shells 188, 190 along the lateral axis 193. The links 200 may be severed from the shells 188, 190 prior to or after the shells 188, 190 are coupled to each other to surround the outer contact 136. In an embodiment, the shells 188, 190 are each composed of a dielectric material, such as one or more plastics. The shells 188, 190 may be formed by a molding process. The carrier strips 198 may be formed with the respective shells 188, 190 during the same molding process. In an embodiment, the upper shell 188 has a unitary, one-piece body 202, and the lower shell 190 has a unitary one-piece body 204. Thus, the latching features on the upper and lower shells 188, 190 that are used to couple the shells 188, 190 to each other may be formed integral to the respective bodies 202, 204 of the shells 188, 190. Alternatively, one or more latching features or other components may be attached to a corresponding shell 188, 190 after forming the shell 188, 190, such as via bonding, an adhesive, a fastener, or the like.

The body 202 of the upper shell 188 is curved between a first edge 206 and a second edge 208. The first edge 206 is laterally spaced apart from the second edge 208. The upper shell 188 extends longitudinally along the mating axis 112 between a front end 210 and a rear end 212. The first and second edges 206, 208 extend the length of the upper shell 188 between the front and rear ends 210, 212. The curved body 202 includes an inner surface 214 and an outer surface 216. The inner surface 214 defines a portion of the channel 166 (shown in FIG. 2) when the cavity insert 138 is assembled. The outer surface 216 defines a portion of an outer perimeter of the assembled cavity insert 138. The body 202 of the upper shell 188 in an embodiment defines approximately half of the outer perimeter of the assembled cavity insert 138, but may define more or less than half of the outer perimeter of the cavity insert 138 in other embodiments. In the orientation shown in FIG. 3, the body 202 has a convex curve relative to the links 200 that extend from the body 202, such that the body 202 arches upward from the edges 206, 208.

The upper shell 188 includes latching components used to couple the upper shell 188 to the lower shell 190. For example, the upper shell 188 in the illustrated embodiment includes a strap 218 that extends beyond the first edge 206 of the upper shell 188 towards the lower shell 190. The strap 218 extends generally vertically downward from the first edge 206. The strap 218 includes a latching surface 220 that is configured to engage a corresponding catch 284 of the lower shell 190 to couple the upper shell 188 to the lower shell 190. The upper shell 188 also includes multiple catches 222 that are spaced apart along the length of the upper shell 188. The catches 222 are each configured to engage a latching surface 250 of corresponding straps 248 of the lower shell 190. In the illustrated embodiment, the upper shell 188 includes three catches 222, including a first catch 222A proximate to the front end 210, a second catch 222B proximate to the rear end 212, and a third catch 222C disposed axially between the first and second catches 222A, 222B. The three catches 222A-C are all disposed along the outer surface 216 proximate to the second edge 208 of the upper shell 188. The upper shell 188 may include other than three catches 222 proximate to the second edge 208 in an alternative embodiment.

In the illustrated embodiment, the catches 222 of the upper shell 188 are defined by hook surfaces of respective tabs 224 that protrude radially outward from the outer surface 216. The tabs 224 may align with corresponding flange segments 226 that define portions of the flanges 186 (shown in FIG. 2) of the assembled cavity insert 138. The outer surface 216 of the upper shell 188 may include one or more planar regions 228 proximate to the second edge 208. The outer surface 216 along the planar regions 228 is flat or planar, as opposed to being curved. The catches 222 are disposed along the planar regions 228. For example, the tabs 224 protrude radially outward from the planar regions 228 of the outer surface 216.

The body 204 of the lower shell 190 is curved between a first edge 236 and a second edge 238 that are spaced apart laterally relative to one another. The lower shell 190 extends longitudinally along the mating axis 112 between a front end 240 and a rear end 242. The first and second edges 236, 238 extend the length of the lower shell 190 between the front and rear ends 240, 242. The curved body 204 includes an inner surface 244 and an outer surface 246. The inner surface 244 defines a portion of the channel 166 (shown in FIG. 2), and the inner surface 214 of the upper shell 188 defines a remaining portion of the channel 166 when the cavity insert 138 is assembled. The outer surface 246 defines a portion of the outer perimeter of the assembled cavity insert 138, such that the outer surfaces 216, 246 of the upper and lower shells 188, 190 define an entirety of the outer perimeter of the cavity insert 138. In the orientation shown in FIG. 3, the body 204 has a concave curve relative to the links 200 that extend from the body 204, such that the body 204 arches downward from the edges 236, 238.

The lower shell 190 includes latching components used to couple the lower shell 190 to the upper shell 188. For example, the lower shell 190 in the illustrated embodiment includes multiple straps 248 that extends beyond the first edge 236 of the lower shell 190 towards the upper shell 188. The straps 248 extend generally vertically upward from the first edge 236. The straps 248 each include a latching surface 250 that is configured to engage a corresponding catch 222 of the upper shell 188 to couple the upper and lower shells 188, 190. In the illustrated embodiment, the lower shell 190 includes three straps 248, including a first strap 248A proximate to the front end 240, a second strap 248B proximate to the rear end 242, and a third strap 248C disposed axially between the first and second straps 248A, 248B. The latching surfaces 250 of the first, second, and third straps 248A-C align with and engage the first, second, and third catches 222A-C of the upper shell 188, respectively, when the shells 188, 190 are coupled. The three straps 248A-C of the lower shell 190 are all disposed along (and extend from) the first edge 236 of the lower shell 190. The lower shell 190 may include other than three total straps 248 and/or other than three straps 248 along the first edge 236 in an alternative embodiment.

The straps 248A-C may have the same or similar sizes and shapes as one another. Each strap 248 is a cantilevered beam or limb that protrudes beyond or from the first edge 236 to a respective free end 252. The straps 248 are at least semi-rigid, such that the straps 248 are able to deflect and resiliently return towards an initial, resting position when a deflecting force on the strap 248 is removed. Each strap 248 includes an inner side 254 that faces the channel 166 (shown in FIG. 2) and an opposite outer side 256 that faces outward away from the channel 166. The inner side 254 may be approximately planar, and the outer side 256 may be curved. In an embodiment, the straps 248 each define an aperture 258 that extends through the respective strap 248 between the inner and outer sides 254, 256. The aperture 258 is defined along a portion of the strap 248 that extends beyond the first edge 236. The latching surface 250 is a distal wall of the aperture 258. The distal wall 250 is proximate to the free end 252 of the respective strap 248. The distal wall 250 may face generally vertically downward and/or towards the first edge 236 from which the strap 248 extends. In an alternative embodiment, the aperture 258 does not extend fully through the respective strap 248, but rather is a recess or indentation defined along the inner side 254 of the strap 248. The latching surface 250 in such alternative embodiment may be a distal wall of the recess.

Although not shown in FIG. 3, in an embodiment the lower shell 190 includes at least one catch 284 (shown in FIG. 4) that extends from the outer surface 246 proximate to the second edge 238. The catch 284 may be similar in shape, size, and/or features to the catches 222 of the upper shell 188. In addition, although only partially visible in FIG. 3, the strap 218 of the upper shell 188 optionally may be substantially similar in shape, size, and/or features to the straps 248 of the lower shell 190. In an embodiment, both the upper shell 188 and the lower shell 190 are hermaphroditic such that each shell 188, 190 includes at least one catch and at least one strap that includes a latching surface. In an alternative embodiment, the shells 188, 190 are not hermaphroditic such that the upper shell 188 includes only straps 218 or only catches 222, and the lower shell 190 includes only the complementary latching features, such as only multiple catches 284 or only multiple straps 248.

As shown in FIG. 3, the straps 218, 248 of the upper and lower shells 188, 190, respectively, are disposed along the respective first edges 206, 236 of the shells 188, 190. The straps 218, 248 are not located along the respective second edges 208, 238. Furthermore, the respective catches 222, 284 (shown in FIG. 4) are disposed proximate to the second edges 208, 238, of the shells 188, 190, but not proximate to the first edges 206, 236. In one or more alternative embodiments, however, the upper shell 188 may include at least one strap 218 disposed along each of the first and second edges 206, 208 and/or at least one catch 222 proximate to each of the first and second edges 206, 208. Similarly, in an alternative embodiment the lower shell 190 may include at least one strap 248 disposed along each of the first and second edges 236, 238 and/or at least one catch 284 proximate to each of the first and second edges 236, 238.

In an embodiment, the upper shell 188 and the lower shell 190 have identical shapes. For example, the size, contour, and features of the upper shell 188 are identical to the size, contour, and features of the lower shell 190. The upper and lower shells 188, 190 may be formed via the same process, such as by being formed in the same or an identical mold. Thus, both the upper and lower shells 188, 190 are able to be produced using only a single mold, which may reduce manufacturing costs. In the illustrated embodiment, the lower shell 190 is oriented 180 degrees relative to the upper shell 188 about the mating axis 112. For example, since the upper shell 188 is identical to the lower shell 190, the strap 218 of the upper shell 188 that is visible in FIG. 3 is the same as the first strap 248A of the lower shell 190. The use of the term "identical" herein recognizes that the one or both shells 188, 190 may have imperfections, blemishes, and other de minimis irregularities that are not shared by both shells 188, 190 (for example, resulting from the manufacturing process or subsequent handling).

As shown in FIG. 3, the outer contact 136 may include a protrusion 260 that extends radially outward from the middle segment 156 of the outer contact 136. The lower shell 190 defines an indentation 262 along the inner surface 244. The indentation 262 receives the protrusion 260 therein when the upper and lower shells 188, 190 are coupled to secure the outer contact 136 within the cavity insert 138. As shown in FIG. 3, the lower shell 190 defines two indentations 262, with one indentation 262 proximate to the first edge 236 and the other indentation 262 proximate to the second edge 238. Based on the orientations of the outer contact 136 and the lower shell 190 in the illustrated embodiment, the protrusion 260 is received within the indentation 262 proximate to the first edge 236, and another protrusion (not shown) of the middle segment 156 may be received in the other indentation 262 proximate to the second edge 238. The receipt of the protrusion 260 in the corresponding indentation 262 may axially and rotationally lock or secure the outer contact 136 relative to the cavity insert 138. Although not shown, the upper shell 188 may define one or more indentations that interface with the indentations 262 to define larger recesses. In an alternative embodiment, the mating segment 156 may define a depression and the cavity insert 138 may include a protrusion that is configured to extend into the depression. The cavity insert 138 may additionally secure the axial position of the outer contact 136 via engagement with the first step 158 and/or the second step 160 of the outer contact 136 or one or more other parts of the outer contact 136.

Figure 4:
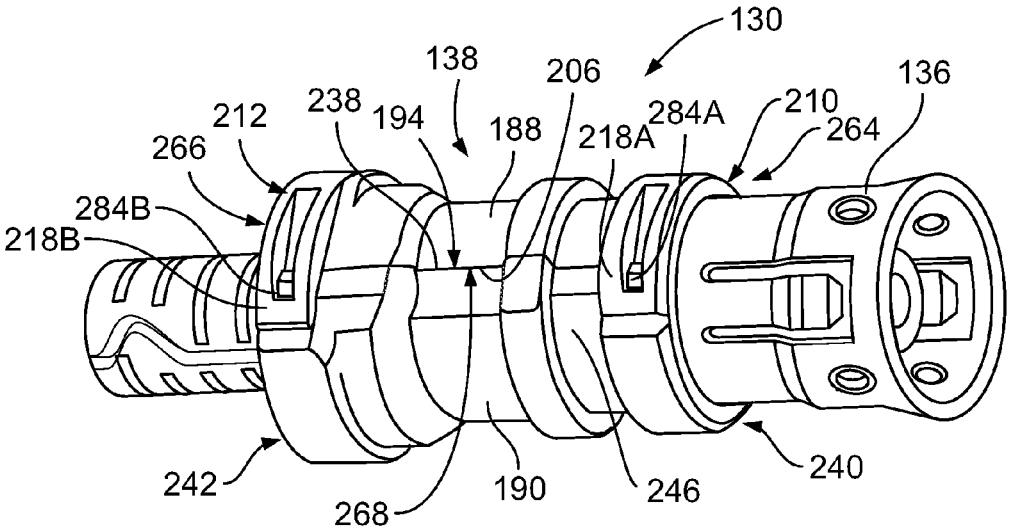
FIG. 4 is a side perspective view of the contact assembly in an assembled state according to an embodiment.

FIG. 4 is a side perspective view of the contact assembly 130 in an assembled state according to an embodiment. The cavity insert 138 is whole in FIG. 4 such that the upper shell 188 is coupled to the lower shell 190 to surround the outer contact 136. The illustrated embodiment of the cavity insert 138 differs slightly from the embodiment shown in FIG. 3 because the cavity insert 138 only includes two latching features instead of three along the length of the cavity insert 138. The cavity insert 138 extends between a front end 264 and a rear end 266. The front end 264 is defined by the front end 210 of the upper shell 188 and the front end 240 of the lower shell 190. The rear end 266 is defined by the respective rear ends 212, 242 of the upper and lower shells 188, 190. In the illustrated embodiment, the upper shell 188 includes a first strap 218A proximate to the front end 264 of the cavity insert 138 and a second strap 218B proximate to the rear end 266. The second strap 218B is identical or as similar to the first strap 218A. The straps 218A, 218B both extend across the interface 194 defined between the shells 188, 190 to engage corresponding catches 284A, 284B of the lower shell 190. The interface 194 between the shells 188, 190 defines a first seam 268 between the first edge 206 of the upper shell 188 and the second edge 238 of the lower shell 190. The first seam 268 extends the length of the cavity insert 138. The straps 218A, 218B extend across the first seam 268. The straps 218A, 218B overlap portions of the outer surface 246 of the lower shell 190 proximate to the catches 284A, 284B. Although not visible in FIG. 4, the interface 194 also defines a second seam 270 (shown in FIG. 6) that extends the length of the cavity insert 138 between the second edge 208 of the upper shell 188 and the first edge 236 of the lower shell 190.

Figure 5:
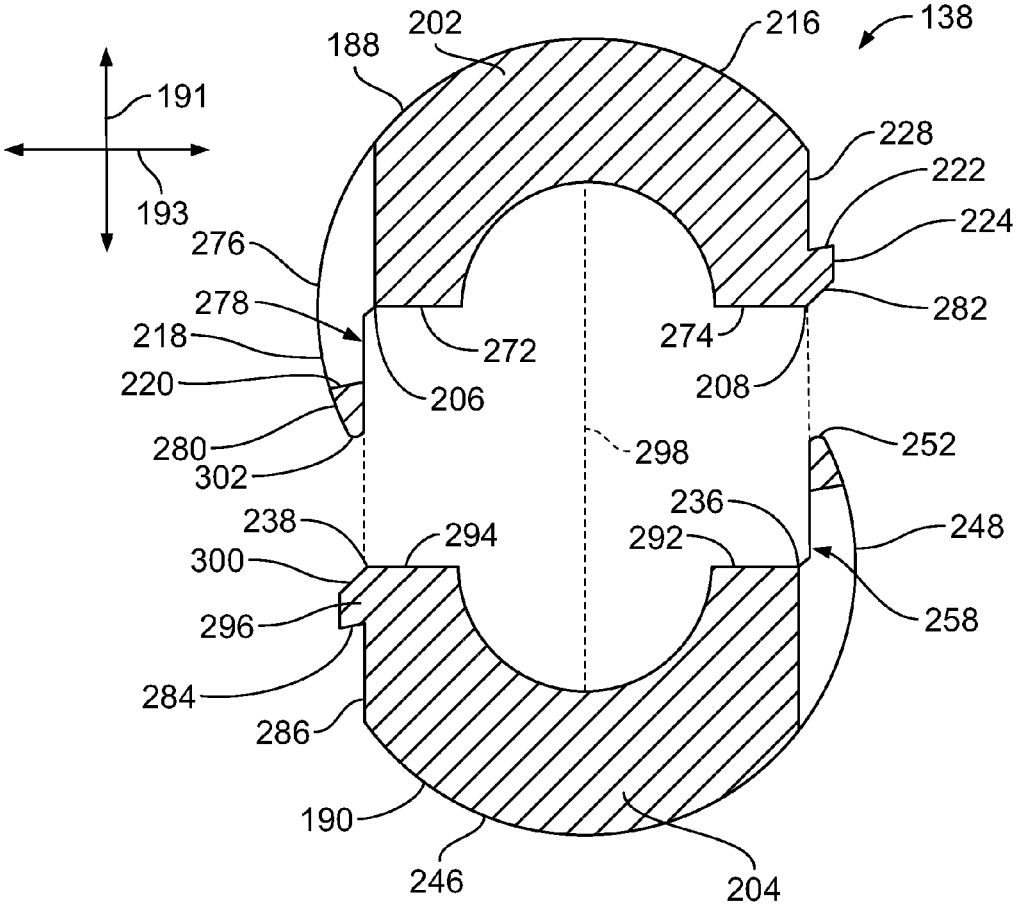
FIG. 5 is an exploded cross-sectional view of a cavity insert of the female connector taken along line 5-5 shown in FIG. 2.

FIG. 5 is an exploded cross-sectional view of the cavity insert 138 taken along line 5-5 shown in FIG. 2. The upper shell 188 is poised for coupling to the lower shell 190. In the illustrated embodiment, the curved body 202 of the upper shell 188 includes a first shoulder 272 at the first edge 206 and a second shoulder 274 at the second edge 208. The shoulders 272, 274 are generally planar surfaces that extend inward from the respective edges 206, 208. The strap 218 of the upper shell 188 is disposed proximate to the first shoulder 272 and extends beyond the first shoulder 272. In the illustrated embodiment, the strap 218 is disposed outward of the shoulder 272 such that the shoulder 272 extends inward from the edge 206 and the strap 218 extends outward from the edge 206. The catch 222 of the upper shell 188 is disposed along the planar region 228 of the outer surface 216 proximate to the second shoulder 274.

The strap 218 extends from a fixed end 276 at the body 202 to a free end 302. The fixed end 276 may be at the first edge 206 or may be spaced apart from the first edge 206 along a perimeter of the outer surface 216 of the upper shell 188. The strap 218 defines an aperture 278 that extends through the strap 218. The aperture 278 is similar to the aperture 258 that extends through the strap 248 of the lower shell 190. The aperture 278 may be defined between a tip segment 280 of the strap 218 and the first edge 206. The tip segment 280 includes the free end 302. The tip segment 280 also includes the latching surface 220. For example, the latching surface 220 may be a distal wall of the aperture 278.

The catch 222 of the upper shell 188 is a hook surface of the tab 224 that protrudes outward from the outer surface 216. In an embodiment, the hook surface 222 may have an acute angle relative to the planar region 228 above the tab 224. For example, the hook surface 222 is angled to extend at least slightly away from the edge 208 along the vertical axis 191. In an alternative embodiment, the hook surface 222 may extend perpendicular to the planar region 228. In the illustrated embodiment, the tab 224 includes a ramp surface 282 that slopes outward away from the planar region 228 of the outer surface 216 as the distance from the second edge 208 increases. The ramp surface 282 extends from the second edge 208 in the illustrated embodiment, but the tab 224 may be spaced apart from the edge 208 in other embodiments. The hook surface 222 is disposed on an opposite side of the tab 224 relative to the ramp surface 282.

The curved body 204 of the lower shell 190 includes a first shoulder 292 at the first edge 236 and a second shoulder 294 at the second edge 238. The shoulders 292, 294 are generally planar surfaces that extend inward from the respective edges 236, 238. The strap 248 of the lower shell 190 is disposed proximate to the first shoulder 292 and extends beyond the first shoulder 292. The catch 284 of the lower shell 190 is disposed along a planar region 286 of the outer surface 246 proximate to the second shoulder 294.

In the illustrated embodiment, the lower shell 190 is identical to the upper shell 188. For example, the lower shell 190 shown in FIG. 5 would align with the upper shell 188 if the lower shell 190 is rotated 180 degrees clockwise (or counterclockwise). Thus, the latching features of the lower shell 190 have identical shapes as the latching features of the upper shell 188, and will not be described in detail herein. For example, the strap 248 may be identical to the strap 218, and the catch 284 may be a hook surface of a tab 296 that is identical to the tab 224.

To couple the upper and lower shells 188, 190, the shells 188, 190 are moved towards one another along a coupling axis 298. The distal end 302 of the strap 218 of the upper shell 188 moves along and/or parallel to the planar region 286 of the lower shell 190 and engages a ramp surface 300 of the tab 296. The strap 218 slides along the tab 296 and deflects radially outward from the natural resting position of the strap 218 shown in FIG. 5. The distal end 302 slides along the tab 296 until the latching surface 220 clears the hook surface 284 of the tab 296. After the latching surface 220 clears the hook surface 284, the tab 296 is allowed to resiliently move radially inward towards the natural resting position of the strap 218. Meanwhile, the distal end 252 of the strap 248 engages the ramp surface 282 of the tab 224 and deflects around the tab 224 in the same way as the strap 218 engages and deflects around the tab 296.

Figure 6:
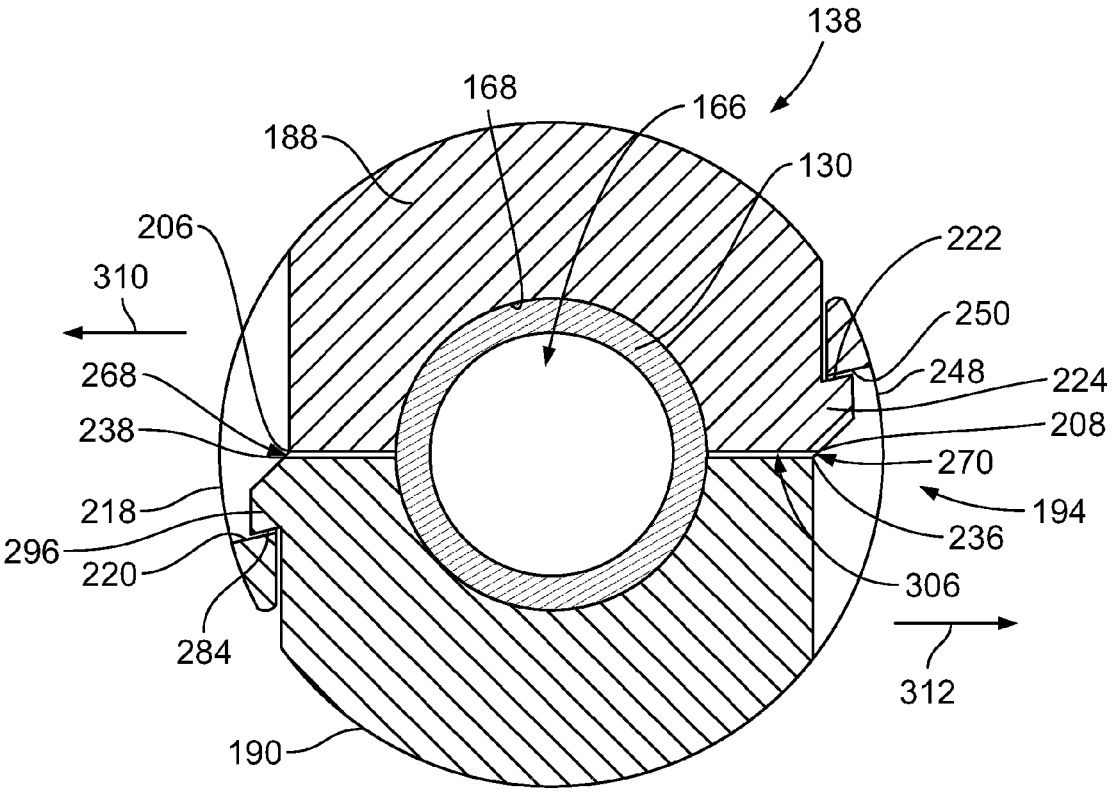
FIG. 6 is an assembled cross-sectional view of the cavity insert and an outer contact taken along the line 5-5.

FIG. 6 is an assembled cross-sectional view of the cavity insert 138 and the outer contact 136 taken along the line 5-5. In the assembled state, the first edge 206 of the upper shell 188 aligns with the second edge 238 of the lower shell 190, and the latching surface 220 of the strap 218 engages the hook surface 284 of the tab 296. Furthermore, the second edge 208 of the upper shell 188 aligns with the first edge 236 of the lower shell 190, and the latching surface 250 of the strap 248 engages the hook surface 222 of the tab 224. Optionally, there may be a slight clearance between the latching surfaces 220, 250 and the corresponding hook surfaces 222, 284. The first shoulder 272 of the upper shell 188 faces and may engage the second shoulder 294 of the lower shell 190, and the second shoulder 274 of the upper shell 188 faces and may engage the first shoulder 292 of the lower shell 190. Optionally, there may be a slight gap 306 between the shoulders 272, 274 of the upper shell 188 and the corresponding shoulders 294, 292 of the lower shell 190. The interface 194 may be defined between the shoulders 272, 274, 292, 294. For example, the first seam 268 of the interface 194 is defined between the shoulder 272 and the shoulder 294, and the second seam 270 is defined between the shoulder 274 and the shoulder 292. The strap 218 extends from the upper shell 188 across the first seam 268 to engage the tab 296 of the lower shell 190. The strap 248 extends from the lower shell 190 across the second seam 270 to engage the tab 224 of the upper shell 188.

As shown in FIG. 6, the outer contact 136 is disposed within the channel 166 of the cavity insert 138. In an embodiment, the outer contact 136 may support the assembled state of the cavity insert 138 by providing an interior support on the inner surface 168 of the cavity insert 138. In the illustrated embodiment, without the interior support of the outer contact 136, the upper shell 188 may be able to uncouple from the lower shell 190 by sliding the upper shell 188 in one direction 310 and the lower shell 190 in an opposite direction 312. Thus, the cavity insert 138 may be configured such that the cavity insert 138 is able to disassemble if the outer contact 138 is not within the channel 166 or has a diameter that is too small relative to the channel 166, to ensure that the contact assembly 130 (shown in FIG. 2) is assembled properly.

Figure 7:
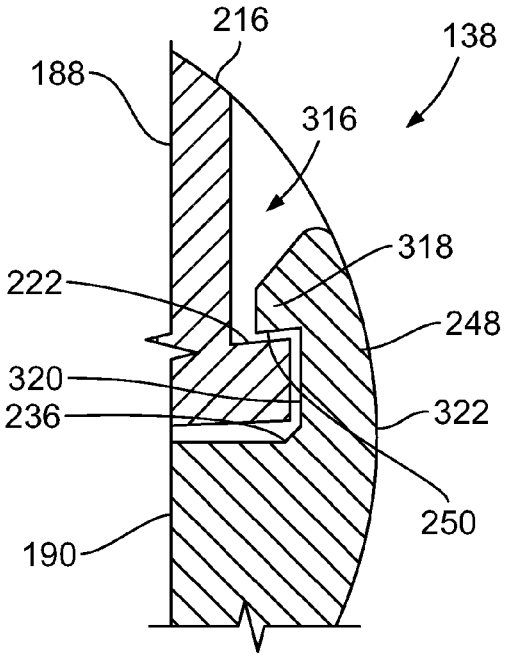
FIG. 7 is a cross-sectional view of a portion of the assembled cavity insert according to an alternative embodiment.

FIG. 7 is a cross-sectional view of a portion of the assembled cavity insert 138 according to an alternative embodiment. FIG. 7 shows the latching surface 250 of the strap 248 of the lower shell 190 coupled to the catch 222 of the upper shell 188. However, instead of the catch 222 being a hook surface of a tab the projects outward from the outer surface 216, the catch 222 in the illustrated embodiment is a wall of a recess 316 that is defined along the outer surface 216. The wall 222 extends inward towards the channel 166 (shown in FIG. 6) from the outer surface 216. The latching surface 250 of the strap 248 in the illustrated embodiment is a hook surface of a tab 318 that protrudes from an inner side 320 of the strap 248. The hook surface faces generally towards a fixed end 322 of the strap 248 and/or the first edge 236 of the lower shell 190. The tab 318 extends into the recess 316 when the upper and lower shells 188, 190 are coupled.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

an outer contact having a mating segment, a terminating segment, and a middle segment therebetween, the mating segment configured to engage a mating contact of a mating connector, the terminating segment configured to be electrically connected to a cable; and a cavity insert having a front end and a rear end and defining a channel that receives the outer contact therein, the cavity insert surrounding the middle segment of the outer contact, the cavity insert defined by an upper shell and a lower shell that couple together at an interface, the first strap located at the front end of the cavity insert, the second strap spaced apart from the first strap and located at the rear end, the upper shell extending along a portion of a perimeter of the outer contact, the lower shell extending along a remaining portion of the perimeter of the outer contact, wherein the upper shell has a curved body extending between a first edge and a second edge, the upper shell including a first strap and a second strap that extend beyond the first edge across the interface, the upper shell further including a catch proximate to the second edge, the first and second straps and the catch formed integral to the body of the upper shell, wherein the lower shell has an identical shape as the upper shell and is oriented 180 degrees relative to the upper shell about a mating axis that is parallel to the channel, wherein a latching surfaces of the first and second straps of the upper shell engages the catch of the lower shell and a latching surface of the first strap of a lower shell engages corresponding first and second catches of a upper shell to couple a upper shell to a lower shell.

2. The electrical connector of claim 1, wherein the curved body of the upper shell extends between a first shoulder at the first edge and a second shoulder at the second edge, the first and second shoulders engaging corresponding shoulders of the lower shell at the interface, the first strap of the upper shell disposed proximate to the first shoulder and extending beyond the first shoulder towards the lower shell.

3. The electrical connector of claim 1, wherein the curved body of the lower shell extends between a first shoulder at the first edge and a second shoulder at the second edge, the first and second catches of the lower shell located proximate to the second shoulder along a planar region of an outer surface of the body of the lower shell, each of the first and second catches of the lower shell including at least one of a hook surface of a tab that protrudes outward from the outer surface relative to the channel or a wall of a recess that extends inward from the outer surface relative to the channel.

4. The electrical connector of claim 1, wherein the first strap of the upper shell is cantilevered and extends to a free end, the first strap including an inner side that faces the channel and an opposite, outer side, the first strap defining an aperture therethrough between the inner and outer sides, the latching surface being a distal wall of the aperture proximate to the free end of the first strap.

5. The electrical connector of claim 1, wherein the first strap of the upper shell is cantilevered and extends from a fixed end to a free end, the first strap including an inner side that faces the channel, the first strap including a tab that protrudes from the inner side of the first strap, the latching surface of the first strap being a surface of the tab generally facing the fixed end of the strap.

6. The electrical connector of claim 1, wherein the middle segment of the outer contact includes a protrusion that extends radially outward from the middle segment, the cavity insert defining an indentation along an inner surface thereof that defines the channel, the protrusion being received in the indentation when the upper and lower shells are coupled together to secure the outer contact within the cavity insert.

7. The electrical connector of claim 1, wherein the first and second edges of the upper shell extend a length of the cavity insert between a front end and a rear end thereof, the upper shell including the first strap and a second strap protruding from the first edge across the interface, the first and second straps spaced apart along the length of the cavity insert, the catch of the upper shell is defined by a first tab of multiple tabs extending from an outer surface of the upper shell proximate to the second edge, the tabs spaced apart along the length of the cavity insert, the tabs of the upper shell including respective hook surfaces that engage corresponding straps of the lower shell.

8. The electrical connector of claim 1, wherein the upper shell lacks a strap extending from the second edge across the interface.

9. An electrical connector comprising:

an outer contact having a mating segment, a terminating segment, and a middle segment therebetween, the mating segment configured to engage a mating contact of a mating connector, the terminating segment configured to be electrically connected to a cable; and a cavity insert defining a channel that receives the outer contact therein, the cavity insert surrounding the middle segment of the outer contact, the cavity insert defined by an upper shell and a lower shell that couple together at an interface, the upper shell extending along a portion of a perimeter of the outer contact, the lower shell extending along a remaining portion of the perimeter of the outer contact, the upper shell having a curved body extending between a first edge and a second edge, the upper shell including a first strap extending from the first edge towards the lower shell, the first strap including a latching surface, the upper shell further including a first tab extending from an outer surface of the upper shell proximate to the second edge, the first tab located along a planar region of the outer surface of the upper shell and protruding radially outward from the planar region, the first tab having a hook surface that defines a catch, the first strap and the first catch tab formed integral to the body, wherein the lower shell has an identical shape as the upper shell and is oriented 180 degrees relative to the upper shell about a mating axis that is parallel to the channel;

wherein the first edge of the upper shell aligns with a second edge of the lower shell at the interface such that hook surface of the latching surface of the first strap of the upper shell engages a first tab of the lower shell, the second edge of the upper shell aligning with a first edge of the lower shell at the interface such that the first tab of the upper shell engages a latching surface of a first strap of the lower shell.

10. The electrical connector of claim 9, wherein the upper and lower shells each include a first shoulder at the respective first edge and a second shoulder at the respective second edge, the first shoulder of the upper shell engaging the second shoulder of the lower shell and the second shoulder of the upper shell engaging the first shoulder of the lower shell to define the interface.

11. The electrical connector of claim 9 as the upper and lower shells are coupled together, the first strap of the lower shell is configured to move along the planar region of the upper shell and engage a ramp surface of the first tab of the upper shell, the ramp surface deflecting the first strap radially outward until the latching surface of the first strap clears the hook surface of the tab and the first strap resiliently moves radially inward towards the planar region.

12. The electrical connector of claim 9, wherein the first strap of the upper shell is cantilevered and extends to a free end, the first strap including an inner side that faces the channel and an opposite, outer side, the first strap defining an aperture therethrough between the inner and outer sides, the latching surface being a distal wall of the aperture proximate to the free end of the first strap.

13. The electrical connector of claim 9, wherein the cavity insert has a front end and a rear end, the first strap of the upper shell disposed proximate to the front end of the cavity insert, the upper shell further including a second strap that is proximate to the rear end of the cavity insert, the second strap extending across the interface, the second strap including a latching surface that engages a hook surface of a corresponding second tab of the lower shell.

14. The electrical connector of claim 13, wherein the second strap of the upper shell extends towards the lower shell from the first edge of the upper shell, the upper shell lacking a strap extending from the second edge thereof.

15. An electrical connector comprising:

an outer housing having a front end and defining a cavity that extends into the outer housing from the front end, the cavity configured to removably receive a mating connector therein along a mating axis; and a contact assembly disposed within the cavity of the outer housing, the contact assembly comprising:

a center contact configured to engage a first mating contact of the mating connector;

a dielectric body surrounding the center contact;

an outer contact surrounding the dielectric body, the outer contact extending between a mating segment and a terminating segment, the mating segment configured to engage a second mating contact of the mating connector, the terminating segment configured to be electrically connected to a cable; and a cavity insert having an inner surface surrounding and engaging the outer contact, the cavity insert defined by an upper shell and a lower shell that couple together at an interface, the upper shell defining a portion of the inner surface of the cavity insert, the lower shell defining a remaining portion of the inner surface of the cavity insert, the upper shell having a curved body extending between a first edge and a second edge, the lower shell having a curved body extending between a first edge and a second edge, the first edge of the upper shell aligning with the second edge of the lower shell at the interface to define a first seam, the second edge of the upper shell aligning with the first edge of the lower shell at the interface to define a second seam, wherein the upper shell includes a strap extending from the first edge thereof across the first seam, the strap of the upper shell including a latching surface that engages a catch of the lower shell to couple the upper shell to the lower shell, the upper shell lacking a strap extending from the second edge thereof, wherein the strap of each of the upper and lower shells is cantilevered and extends to a respective free end, each of the straps having an inner side that faces the channel and an aperture through the strap between the inner side and an opposite, outer side, the latching surface of each of the straps being a distal wall of the aperture proximate to the free end of the respective strap.

wherein the lower shell includes a strap extending from the first edge thereof across the second seam, the strap of the lower shell including a latching surface that engages a catch of the upper shell to couple the lower shell to the upper shell, the lower shell lacking a strap extending from the second edge thereof.

16. The electrical connector of claim 15, wherein the cavity insert has a generally cylindrical shape and includes a flange extending circumferentially along a perimeter of the cavity insert, the flange engaging the outer housing within the cavity to secure an axial position of the contact assembly relative to the outer housing.

17. The electrical connector of claim 15, wherein the upper shell has an identical shape as the lower shell, the lower shell oriented 180 degrees relative to the upper shell about the mating axis.

18. The electrical connector of claim 15, wherein the strap of the upper shell is formed integral to the body of the upper shell and the strap of the lower shell is formed integral to the body of the lower shell.

19. The electrical connector of claim 15, wherein the outer contact engages the portion of the inner surface of the cavity insert defined by the upper shell and the portion of the inner surface of the cavity defined by the lower shell to maintain the cavity insert in a coupled state by blocking the upper shell and the lower shell from sliding in opposite directions relative to one another parallel to the interface.

* * * * *